US010571824B2

(12) United States Patent
Taniyama et al.

(10) Patent No.: US 10,571,824 B2
(45) Date of Patent: Feb. 25, 2020

(54) OPTICAL WRITING DEVICE AND IMAGE FORMING APPARATUS

(71) Applicant: KONICA MINOLTA, INC., Chiyoda-ku, Tokyo (JP)

(72) Inventors: Akira Taniyama, Hino (JP); Hideo Uemura, Hachioji (JP); Takashi Kurosawa, Hachioji (JP); Naoki Tajima, Hachioji (JP)

(73) Assignee: KONICA MINOLTA, INC., Kyoto (JP)

( * ) Notice: Subject to any disclaimer, the term of this patent is extended or adjusted under 35 U.S.C. 154(b) by 0 days.

(21) Appl. No.: 16/202,776

(22) Filed: Nov. 28, 2018

(65) Prior Publication Data

US 2019/0163088 A1 May 30, 2019

(30) Foreign Application Priority Data

Nov. 30, 2017 (JP) ..... 2017-230476

(51) Int. Cl.
*G03G 15/043* (2006.01)
*G03G 15/01* (2006.01)
*G03G 15/04* (2006.01)

(52) U.S. Cl.
CPC ..... *G03G 15/043* (2013.01); *G03G 15/0189* (2013.01); *G03G 15/0435* (2013.01); *G03G 15/04045* (2013.01)

(58) Field of Classification Search
CPC ..... G03G 15/043; G03G 15/0189; G03G 15/04045; G03G 15/0435
See application file for complete search history.

(56) References Cited

U.S. PATENT DOCUMENTS 8,081,203 B2 * 12/2011 Masuda ..... G02B 26/124 347/236
8,998,372 B2 * 4/2015 Yoshida ..... G03G 15/0435 347/19
9,056,490 B2 * 6/2015 Kusuda ..... B41J 2/44

FOREIGN PATENT DOCUMENTS

JP 2006184650 A 7/2006
JP 2008026410 A 2/2008

* cited by examiner

*Primary Examiner* — Lamson D Nguyen
(74) *Attorney, Agent, or Firm* — Cantor Colburn LLP

(57) ABSTRACT

In an optical writing device that deflects light beams from first and second light source sections and performs scanning by first and second scanning optical systems, in reflective optical elements disposed in the optical axis direction from after the polygon mirror to before a separation mirror, a number of hold points on each of a writing start side and a writing end side in scanning is same, and in reflective optical elements disposed from after the separation mirror up to a surface to be scanned, a number of hold points on a writing start side of the first scanning optical system is same (one) with that on a writing end side of the second scanning optical system, and a number of hold points on a writing end side of the first scanning optical system is same (two) with that on a writing start side of the second scanning optical system.

11 Claims, 9 Drawing Sheets

Comparative Example arrange all reflective optical elements in plane symmetrically Comparative Example arrange all reflective optical elements in point symmetrically Example

OPTICAL WRITING DEVICE AND IMAGE FORMING APPARATUS

CROSS-REFERENCE TO RELATED APPLICATION

The present application claims priority under 35 U.S.C § 119(e) to Japanese patent application No. 2017-230476, filed on Nov. 30, 2017, is incorporated herein by reference in its entirety.

BACKGROUND

1. Technical Field

The present invention relates to an optical writing device and an image forming apparatus.

2. Description of Related Arts

A full color image forming apparatus of an electrophotographying system includes photoconductor drums corresponding to respective colors of Y (yellow), M (magenta), C (cyanogen), and K (black), forms latent images on the respective photoconductor drums with exposure by an optical writing device, and forms toner images by developing the latent images. Then, the toner images are superimposed one after another on an intermediate transfer belt, and thereafter, the superimposed toner images are transferred onto a sheet, thereby forming a color image.

In the above image forming apparatus, from the demands for miniaturization, without providing an independent optical writing device for each of the colors, an optical writing device has been known that performs scanning by deflecting light beams from a plurality of light sources by a single polygon mirror. In such an optical writing device, also in order to prevent color misalignment, it is necessary to make the image formation positions of respective colors coincident with each other with high accuracy. Therefore, it is necessary to set a holding method of optical elements, such as a lens and a reflective mirror, in consideration of the influence of vibration or thermal expansion due to a temperature change in an optical writing device.

Patent Literature 1 (JP 2008-26410A) discloses an optical writing device in which a pair of scanning optical systems and light sources are disposed to face each other across a polygon mirror and the center of a writing width of a surface to be scanned by each of the pair of scanning optical systems and the center of rotation of the polygon mirror are disposed to be on a straight line.

Moreover, Patent Literature 2 (JP 2006-184650A) discloses an optical writing device in which a pair of scanning optical systems and light sources are disposed to face each other across a polygon mirror plane-symmetrically, and a scanning lens of one scanning optical system is brought in contact with a writing start side and a scanning lens of the other scanning optical system is brought in contact with a writing end side.

SUMMARY

In the case of the constitution as disclosed in Patent Literature 1, the light sources and the optical systems are arranged point symmetrically relative to the rotation axis of the polygon mirror. In such a constitution, it is easy to align the writing start positions of respective colors, and then, effects for jitter correction can be expected. On the other hand, in the case where the optical elements have twisted due to the influence of vibration etc., it becomes easy to visually recognize pitch unevenness caused by differences in the image formation positions (registration) of the respective colors, and there arises a problem that a high quality image cannot be acquired.

On the other hand, in the constitution as disclosed in Patent Literature 2, in the case where the light sources and the optical systems are arranged plane symmetrically relative to the rotation axis of the polygon mirror, since the profiles of deviations in the sub-scanning direction at positions in the main scanning direction are aligned, the effects for the visibility of the above-mentioned pitch unevenness can be expected. On the other hand, in the case where the optical elements have twisted due to the influence of vibration etc., there arises a problem that the jitter correction to align the image formation positions in the main scanning direction cannot be performed with high accuracy.

The present invention has been achieved in view of the above-described circumstances, and an object is to provide an optical writing device, and an image forming apparatus capable of achieving both jitter correction with high accuracy and suppression of pitch unevenness.

To achieve the above-mentioned object, according to an aspect of the present invention, an optical writing device reflecting one aspect of the present invention is an optical writing device includes first and second light source units each of which includes one or more light sources; a single polygon mirror that deflects a light beam emitted from each of the first and second light source units; a first scanning optical system that includes one or more reflective optical elements to reflect a light beam and one or more transmissive optical elements to transmit a light beam and forms an image with a light beam emitted from the first light source unit and deflected by the polygon mirror; a second scanning optical system that includes one or more reflective optical elements to reflect a light beam and one or more transmissive optical elements to transmit a light beam and forms an image with a light beam emitted from the second light source unit and deflected by the polygon mirror; and a plurality of first light detecting sensors that are disposed so as to correspond to respective light beams emitted from the first and second light source units and are used for controlling a writing start timing; wherein the first and second light source units, the first and second scanning optical systems, and a housing for holding these components are constituted plane symmetrically relative to a plane including a rotation axis of the polygon mirror and being parallel to a scanning line, in the reflective optical elements held at both end sides in the main scanning direction in the first and second scanning optical systems, a number of hold points for positioning is different between a writing start side and a writing end side in scanning of a light beam, in the reflective optical elements of the first and second scanning optical systems disposed in the optical axis direction from after the polygon mirror to before a separation mirror to guide a light beam to the first light detecting sensor, a number of hold points on each of a writing start side and a writing end side in scanning is same, and in the reflective optical elements disposed from after the separation mirror up to a surface to be scanned, a number of hold points on the writing start side of the first scanning optical system is same with a number of hold points on the writing end side of the second scanning optical system, and a number of hold points on the writing end side of the first scanning optical system is set to same with a number of hold points on the writing start side of the second scanning optical system.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

FIG. 7A and FIG. 7B represent comparative examples, and FIG. 7C represents an example.

DETAILED DESCRIPTION OF EMBODIMENTS

Figure 1:
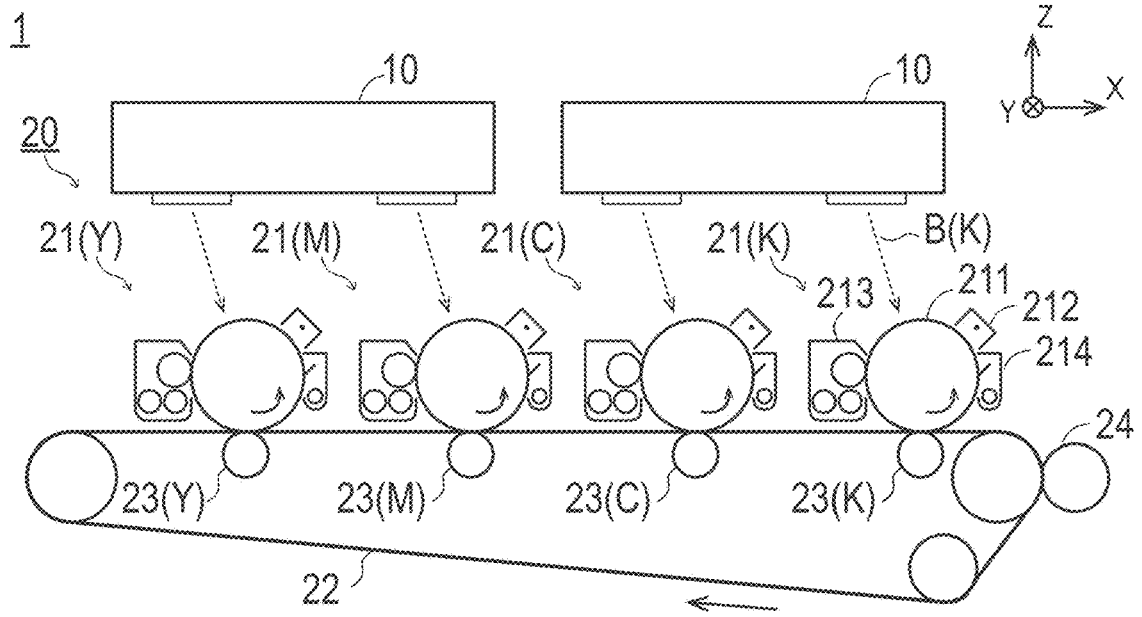
FIG. 1 is a schematic illustration showing an entire constitution of an image forming apparatus according to the first embodiment.

Hereinafter, with reference to attached drawings, embodiments of the present invention will be described in detail. However, the scope of the invention is not limited to the disclosed embodiments. In the description for the drawings, the same constitutional element is provided with the same reference symbol, and the overlapping description is omitted. Moreover, the dimensional ratios in the drawings are exaggerated on account of description, and, may be different from the actual ratios. In the drawings, the vertical direction is defined as the Z direction, the front-to-rear direction in the image forming system is defined as the Y direction, and a direction orthogonal to each of the Z and Y directions is defined as the X direction. Furthermore, in the optical writing device described in the below, a scanning direction (scanning line direction or main scanning direction) is set to the Y direction, the optical axis direction is located on an XZ flat surface, and a part of it is the same as the X direction.

First Embodiment

Figure 2:
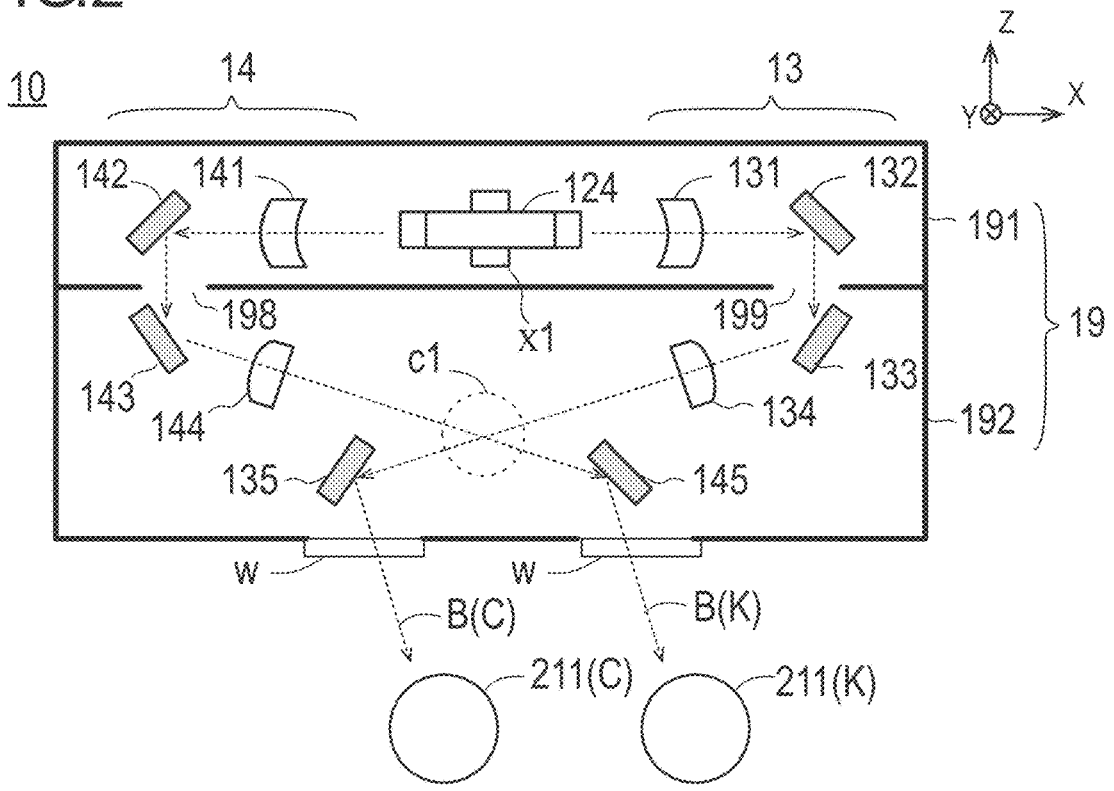
FIG. 2 is a side view showing a constitution of an optical writing device.
Figure 3:
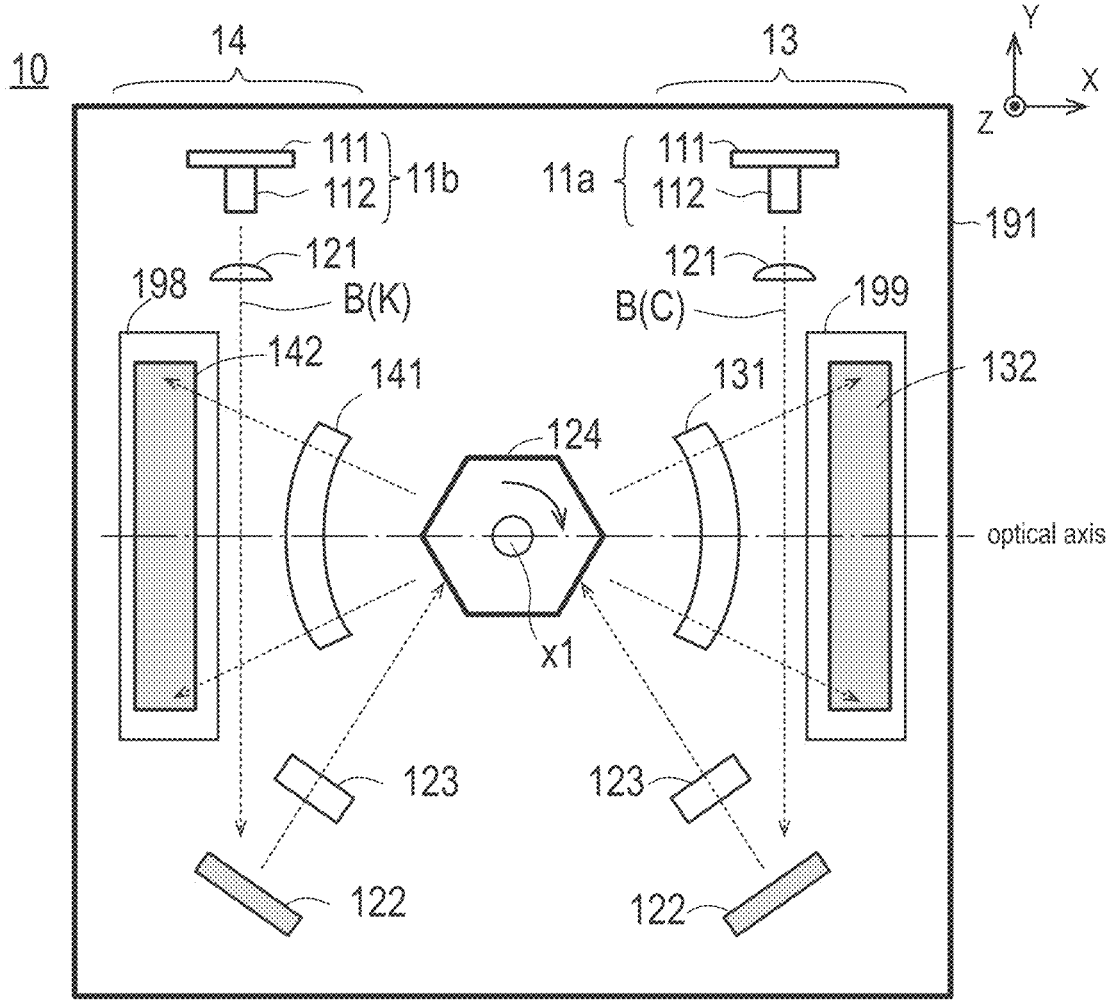
FIG. 3 is a top view showing an upper constitution of an optical writing device.
Figure 4:
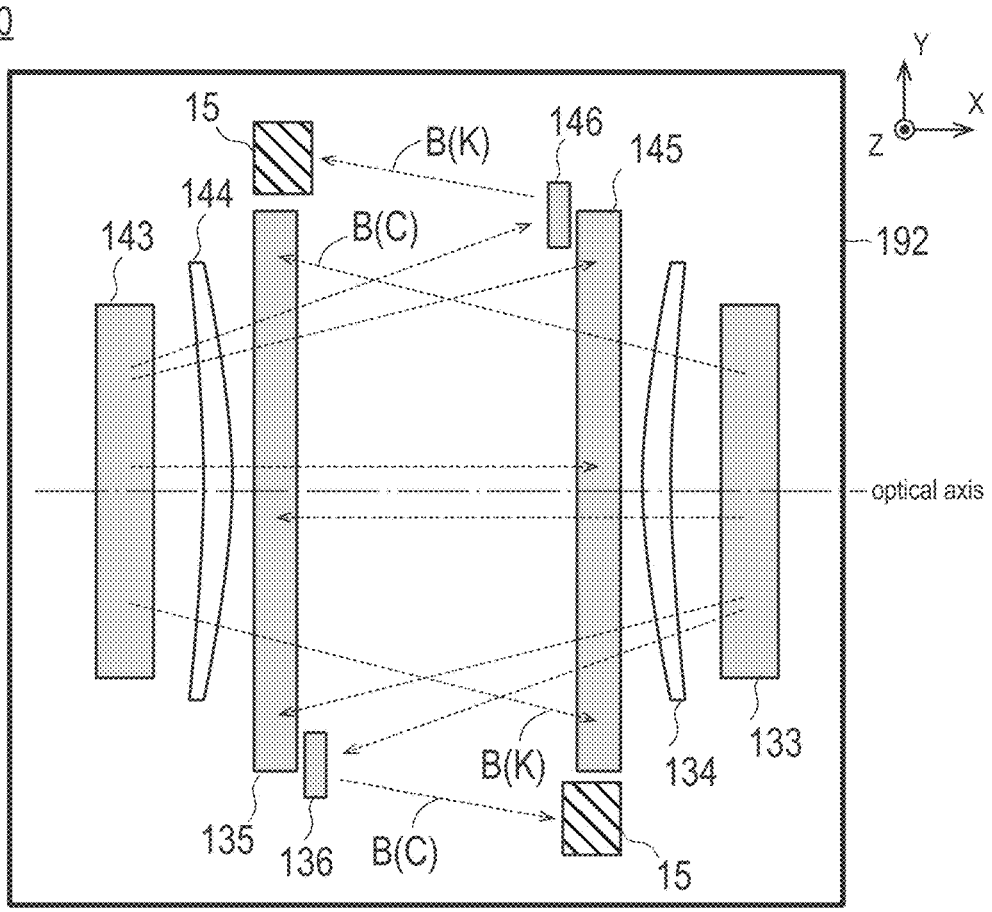
FIG. 4 is a top view showing a lower constitution of an optical writing device.

Hereinafter, with reference to FIG. 1 to FIG. 4, an image forming apparatus 1 and an optical writing device 10 according to the first embodiment are described. FIG. 1 is a schematic illustration showing an entire constitution of the image forming apparatus 1. FIG. 2 to FIG. 4 are schematic illustrations showing a constitution of the optical writing device 10.

As shown in FIG. 1, the image forming apparatus 1 includes two optical writing devices 10 and an image former 20. Hereinafter, first, a constitution of the image former 20 is described, and, next, a constitution of the optical writing device 10 is described.

(Image Former 20)

The image former 20 includes an image creating unit 21, an intermediate transfer belt 22, a primary transfer roller 23, and a secondary transfer roller 24.

The image creating units 21 includes a plurality of image creating units corresponding to respective colors of Y (yellow), M (magenta), C (cyanogen), and K (black), each of which has the same constitution except that the color of toner used for developing is different.

The image creating unit 21 of each of the colors includes a photoconductor drum 211 being a drum-shaped photoconductor, an electrifying electrode 212, a developer 213, and a cleaner 214.

The photoconductor drum 211 that rotates counterclockwise is electrified with the electrifying electrode 212, and thereafter, on its surface, an electrostatic latent image is formed by exposure with light beams B (indicated with an arrow of a broken line in the illustration) emitted from the optical writing device 10 on the basis of image signals. In this connection, each of the two right and left optical writing devices 10 shown in FIG. 1 has an equivalent constitution. Among these, the left-side optical writing device 10 exposes the photoconductor drums 211 for Y and M colors, and the right-side optical writing device 10 exposes the photoconductor drums 211 for C and K colors.

The electrostatic latent image formed on the surface of the photoconductor drum 211 is developed by the developer 213, whereby a mono-color toner image is formed. The mono-color toner image formed by each of the image creating units 21 is superimposed sequentially on the intermediate transfer belt 22 by the primary transfer roller 23 of a corresponding color among the colors, and thereafter, a color toner image composed of the superimposed toner images is transferred by the secondary transfer roller 24 onto a sheet. The color toner image transferred on the sheet is heated and pressed by a fixing device (not shown) located at a downstream side, whereby the color toner image is fused and fixed on the surface of the sheet. On the other hand, the remaining toner remaining on the photoconductor drum 211 without being transferred is cleaned by the cleaner 214.

(Optical Writing Device 10)

As mentioned in the above, the optical writing device 10 for C and K colors and the optical writing device 10 for Y and M colors are equipped with the same constitution. In FIG. 2 to FIG. 4, the optical writing device 10 for C and K is described as a representative.

The optical writing device 10 includes a first light source unit 11*a*, a second light source unit 11*b*, a polygon mirror (deflector) 124, a first scanning optical system 13, a second scanning optical system 14, an SOS (Start Of Scan) sensor 15, a housing 19, and so on. The first scanning optical system 13 is a scanning optical system for C, and the second scanning optical system 14 is a scanning optical system for K, and each of them forms an image on a surface (photoconductor drum 211) to be scanned with a light beams B deflected by the polygon mirror 124.

Each of the first light source unit 11*a* and the second light source unit 11*b* includes a light control board 111 and a light source 112. Each of the first light source unit 11*a* and the second light source unit 11*b* may include a plurality of light sources 112 (for example, two or four light sources 112) so as to be able to perform exposure along a plurality of lines simultaneously on a surface to be scanned by scanning of one time.

In FIG. 3, the polygon mirror 124 rotates clockwise around an axis x1 serving as the center of rotation. Moreover, (1) the light source unit 11*a* for C, a plurality of optical elements including the first scanning optical system 13, and the housing 19 holding these components and (2) the light source unit 11*b* for K, a plurality of optical elements including the second scanning optical system 14, and the housing 19 holding these components, are constituted so as to become plane-symmetric relative to a plane parallel to a scanning line including the axis x1, i.e., a plane (YZ plane) passing through the axis x1. Since they are arranged in this constitution, the scanning direction of a light beam B (C) emitted from the first light source unit 11*a* and the scanning direction (writing direction) of a light beam B (K) emitted from the second light source unit 11*b* are made reverse to each other (refer to below-mentioned FIG. 6 and the like).

As shown in FIG. 2 to FIG. 4, each of the light beams B (C) and B (K) emitted from the two light source units 11*a* and 11*b* enters the single polygon mirror 124 via each of optical elements of a collimating lens 121, a mirror 122, and a cylindrical lens 123, and is deflected. In this connection, these optical elements 121 to 123 are also arranged to become plane-symmetric relative to a plane (YZ plane) passing through the axis x1. Moreover, at the latter stage (downstream side) than the polygon mirror 124 in the optical axis direction, the first scanning optical system 13 and the second scanning optical system 14 are disposed. In the following description, a matter of "a latter stage than a polygon mirror in an optical axis direction" is merely expressed as "after a polygon mirror". Similarly, a matter of "a former stage (latter stage) than a separation mirror in an optical axis direction" is merely expressed as "before (after) a separation mirror".

The first scanning optical system 13 includes a first scanning lens 131, a first mirror 132, a second mirror 133, a second scanning lens 134, a third mirror 135, and a separation mirror 136. Similarly, the second scanning optical system 14 includes a first scanning lens 141, a first mirror 142, a second mirror 143, a second scanning lens 144, a third mirror 145, and a separation mirror 146. Each scanning lens functions as a "transmissive optical element", and each mirror functions as a "reflective optical element". In this connection, in each illustration, the reflective optical element is indicated with a gray color.

As shown in FIG. 2, the housings 19 has a two layer structure of an upper housing 191 and a lower housing 192. As shown in FIG. 3, in the upper housing 191, the light source units 11*a* and 11*b*, the collimating lens 121, the mirror 122, the cylindrical lens 123, the polygon mirror 124, the first scanning lenses 131 and 141, and the first mirrors 132 and 142 are disposed, and these components are held by the upper housing 191. The light beams B (C) and B (K) having passed through these optical elements, pass through the respective openings 198 and 199 in the housing 19, and are guided to the lower housing 192.

As shown in FIG. 2 and FIG. 4, in the lower housing 192, the second mirrors 133 and 143, the second scanning lenses 134 and 144, the third mirrors 135 and 145, the separation mirrors 136 and 146, and the SOS sensors 15 are disposed, and these components are held by the lower housing 192.

The light beams B (C) and B (K) having been guided to the lower housing 192 pass through these optical elements, and thereafter, expose the surfaces, being the surface to be scanned, of the photoconductor drum 211 (C) and 211 (K) through dustproof windows w (refer to FIG. 2) disposed on the undersurface of the lower housing 192.

Moreover, the light beams B enter the separation mirrors 136 and 146 each disposed at the end of the upper stream side in the main scanning direction, are reflected thereon, and are guided to the respective SOS sensors 15. The SOS sensor 15 is constituted by a photodiode, and functions as "a first light detecting sensor". The SOS sensor 15 is used for a writing start timing control. In concrete terms, the writing start timing on a main scanning line is controlled by detecting the incident timing of the light beam B with the SOS sensor 15. The position of this SOS sensor 15 is arranged at a position equivalent to a surface to be scanned in the optical axis direction.

(Number and Position of Hold Point of Reflective Optical Element)

Figure 5:
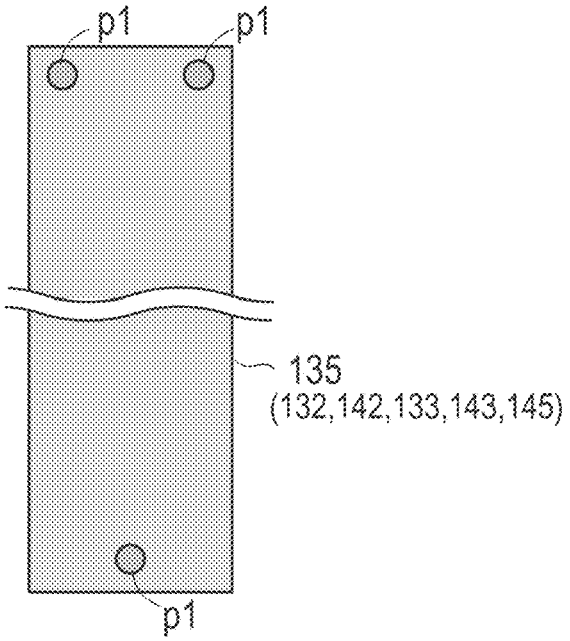
FIG. 5 is a schematic illustration for describing the positions of hold points and the number of hold points of a reflective optical element.

FIG. 5 is a schematic illustration for describing the positions of hold points and the number of hold points of a reflective optical element. In FIG. 5, although the description is given by taking the third mirror 135 as an example, also in other reflective optical elements, the positions of the hold points and the number of hold points are set similarly.

The third mirror 135 is a plate-shaped member, and as shown in FIG. 5, three hold points p1 for positioning are disposed on the back side opposite to the reflective surface, as positioning in the optical axis direction. The third mirror 135 is urged by an elastic member (later-mentioned), such as a plate spring, towards a protruding portion disposed so as to protrude from the housing 19, and at the hold points p1, the back surface of the third mirror 135 comes in contacts with this protruding portion. Two hold points p1 are disposed at one end in the main scanning direction, and one hold point p1 is disposed at the other end, whereby the position of the third mirror in the optical axis direction is determined by a total of three hold points p1.

Figure 6:
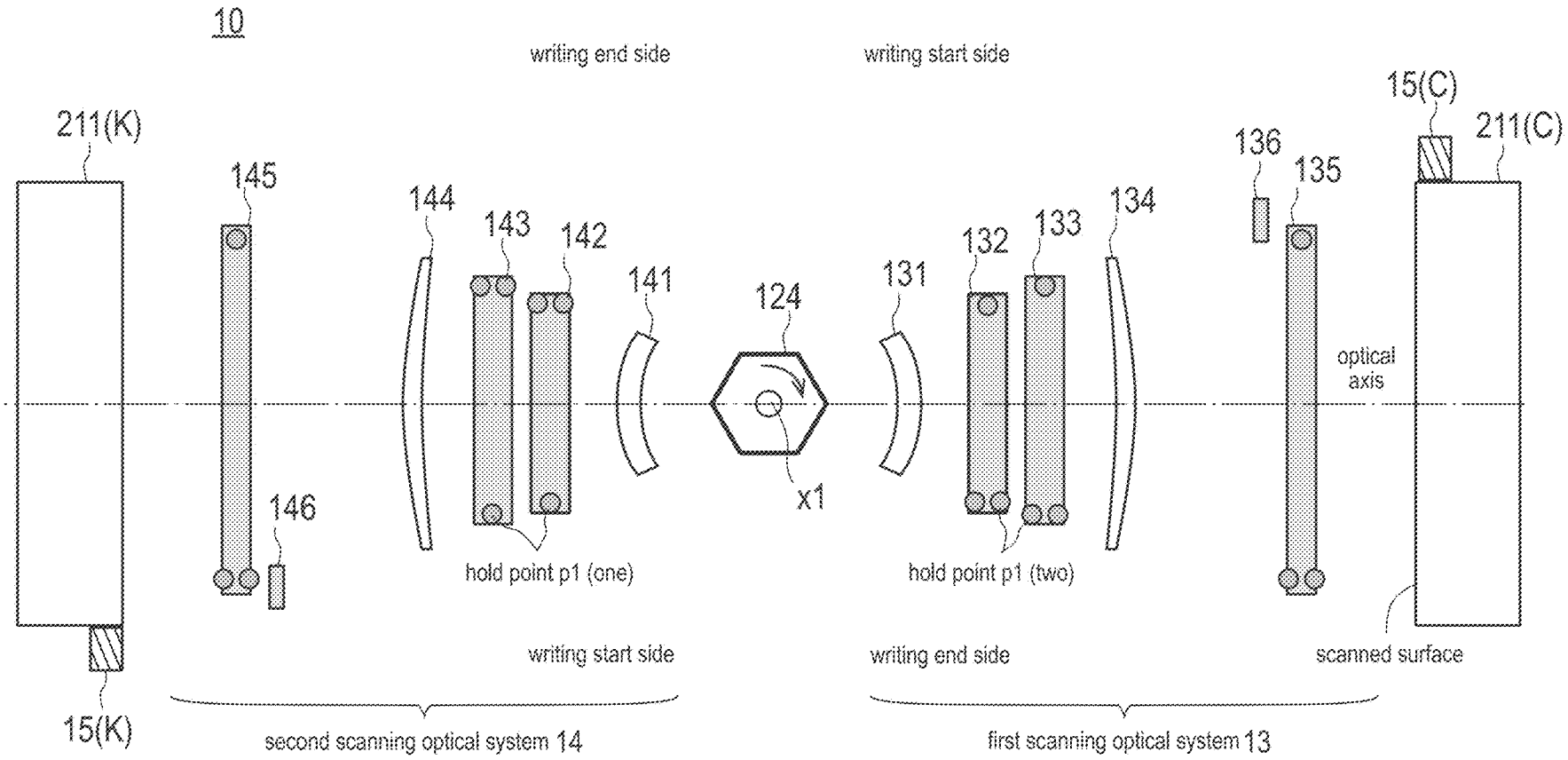
FIG. 6 is a schematic illustration showing each of optical elements of an optical writing device by developing them in the optical axis direction.

FIG. 6 is a schematic illustration showing each of the optical elements of the optical writing device 10 shown in FIG. 2 to FIG. 4 by developing them in the optical axis direction. Moreover, in FIG. 6, the number and positions of the hold points p1 of each of the reflective optical elements are schematically indicated with a circle similarly to FIG. 5.

As shown in FIG. 6, each of the optical elements after the polygon mirror 124 and the housing 19 (except the later-mentioned number and arrangement of hold points) for holding these are constituted so as to become plane-symmetric relative to a plane (YZ plane) parallel to a scanning line including the axis x1 of the polygon mirror 124. Moreover, the scanning direction of the light beam B in the first scanning optical system 13 is reverse to the scanning direction of the light beam B in the second scanning optical system 14. In FIG. 6, in the first scanning optical system 13, the upper side is the writing start side, and the lower side is the writing end side. However, in the second scanning optical system 14, the above arrangement is made reverse.

Moreover, in the first embodiment, as can be understood from FIG. 6, there are provided the constitutions of the following (i) to (iii).

(i) In the first scanning optical system 13 and the second scanning optical system 14, in all the reflective optical elements held at both ends, the number of hold points is different on the writing start side and on the writing end side. In concrete terms, as shown in FIG. 5, in the main scanning direction, two hold points are disposed on one end, and one hold point is disposed on the other end.

(ii) In the reflective optical elements disposed in the optical axis direction from after the polygon mirror 124 to before the separation mirrors 136 and 146, i.e., in the mirrors 132 and 133 of the first scanning optical system 13 and the mirrors 142 and 143 of the second scanning optical system 14, the number of hold points is the same on the writing start side and on the writing end side. That is, the number of hold points on the writing start side is one together, and the number of hold points on the writing end side is two together. In this way, the reflective optical elements and the hold points disposed from after the polygon mirror 124 to before the separation mirrors 136 and 146 are arranged point symmetrically relative to the axis x1 of the polygon mirror 124.

(iii) Moreover, in the reflective optical elements disposed from after the separation mirrors 136 and 146 up to the surface to be scanned, i.e., in the third mirror 135 of the first scanning optical system 13 and the third mirror 145 of the second scanning optical system 14, the number of hold points on the writing start side of the third mirror 135 and the number of hold points on the writing end side of the third mirror 145 are the same one, and the number of hold points on the writing end side of the third mirror 135 and the number of hold points on the writing start side of the third mirror 145 are set to the same two. That is, the reflective optical elements and hold points disposed from after the separation mirrors 136 and 146 up to the surface to be scanned are arranged plane symmetrically relative to a plane including the axis x1 of the polygon mirror 124 and parallel to the scanning line.

(Effect)

Figure 7A:
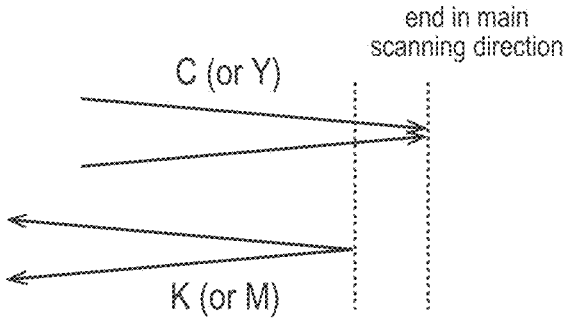
FIG. 7A to FIG. 7C is a schematic illustration for describing the effects of the first embodiment.
Figure 7B:
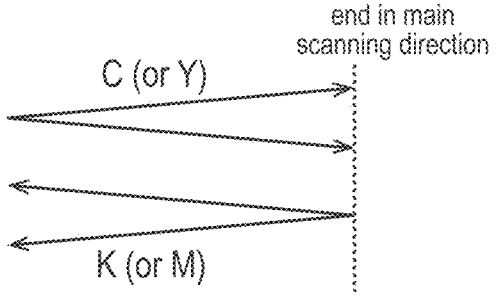
Figure 7C:
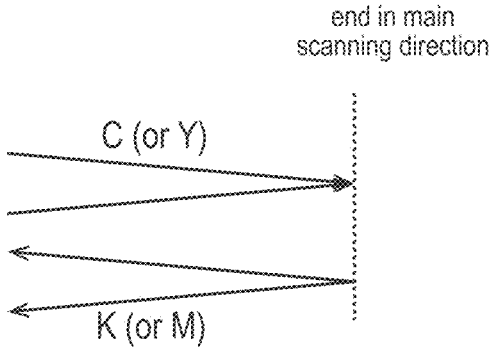

Hereinafter, the effects of the first embodiment are described with reference to FIG. 7. FIG. 7 is a schematic diagram for describing the effects of the first embodiment, FIG. 7A and FIG. 7B represent a comparative Example, and FIG. 7C represents an example according to the first embodiment. Each of these diagrams shows a state where a start point or end point of scanning vibrates due to thermal deformation (thermal expansion) or vibration. In each of the diagrams, for example, in the optical writing device for C and K, two upper lines show vibration of the scanning line of C, and two lower lines show vibration of the scanning line of K. In FIG. 7A, as a comparative example, in the case where all the reflective optical elements and their hold points of the first and second scanning optical systems 13 and 14 are arranged plane symmetrically relative to a plane including the axis x1 of the polygon mirror 124 and parallel to a scanning line, the profile of the main scanning line of each color (C, K (or Y, M)) in one optical writing device is shown in the schematic diagram. In FIG. 7B, as a comparative example, in the case where all the reflective optical elements and their hold points of the first and second scanning optical systems 13 and 14 are arranged point symmetrically relative to the axis x1 of the polygon mirror 124, the profile of the main scanning line of each color in one optical writing device is shown in the schematic diagram. In FIG. 7C, in the case of the arrangement of the first embodiment, i.e., the reflective optical elements and their hold points of the first and second scanning optical systems 13 and 14 are arranged with the above-mentioned constitutions (i) to (iii), the profile of the main scanning line of each color in one optical writing device 10 is shown in the schematic diagram.

As shown in the comparative example of FIG. 7A, in the case of having arranged plane symmetrically, the incident timing of a light beam to the SOS sensor 15 deviates, and the timing of each color is made to deviate. In concrete terms, as shown in FIG. 7A, in the case of having twisted due to thermal deformation and vibration, for example, the influence of the twist is larger in the second scanning optical system 14 than in the first scanning optical system 13. By the incident timing of a light beam to the SOS sensor 15 being made to deviate, the adjustment of the timing of the tip end cannot be performed accurately, which results in deviation. With this, a positional deviation in the main scanning direction between colors arises, and there arises a problem that jitter correction is not performed correctly.

Moreover, as shown in the comparative example in FIG. 7B, in the case of having arranged point symmetrically, there are the following problems. In this comparative example, by twisting due to thermal deformation and vibration, in the case where the skewing (inclination) or bowing (phenomena of curving like an arch in the sub-scanning direction or becoming unevenness) of a main scanning line becomes larger, the profile of deviation in the sub-scanning direction at each position of the main scanning line on the main scanning line of each color is not aligned with those of other colors. For example, since the profile of the main scanning line of the first scanning optical system 13 (Y, C) and the profile of the main scanning line of the second scanning optical system 14 (M, K) are not aligned as shown in FIG. 7B, the appearance pattern of pitch unevenness becomes reversed between two colors (Y and M, or C and K). For this reason, the registration adjustment in the sub-scanning direction for each color does not work, and there arises a problem that pitch unevenness is easily recognized.

On the other hand, as shown in FIG. 7C, in the example, as in the above-mentioned constitution (ii), the hold points of the reflective optical elements disposed from after the polygon mirror 124 to before the separation mirrors 136 and 146 are arranged point symmetrically relative to the axis x1 of the polygon mirror 124. With this constitution, jitter correction can be performed with high accuracy without causing a deviation of the incident timing to SOS sensor 15. Moreover, further, as in the constitution (iii), by arranging the hold points of the reflective optical element after the separation mirrors 136 and 146 plane symmetrically relative to the axis x1 of the polygon mirror 124, the profile of the main scanning line can be aligned, and it is possible to suppress the deterioration of pitch unevenness.

Namely, in the present embodiment, in the optical writing device that deflects light beams from the first and second light source units by a single polygon mirror, the first and second light source units, the first and second scanning optical systems, and the housing holding these components are constituted plane symmetrically relative to a plane including the rotation axis of the polygon mirror and being parallel to a scanning line; in the reflective optical elements held at both end sides in the main scanning direction in the first and second scanning optical systems, the number of hold points for positioning is different between the writing start side and the writing end side in scanning of a light beam; in the reflective optical elements of the first and second scanning optical systems disposed in the optical axis direction from after the polygon mirror to before the separation mirror to guide a light beam to the first light detecting sensor for controlling a writing start timing, the number of hold points on each of the writing start side and the writing end side in scanning is the same; and in the reflective optical elements disposed from after the separation mirror up to a surface to be scanned, the number of hold points on the writing start side of the first scanning optical system is the same with the number of hold points on the writing end side of the second scanning optical system, and the number of hold points on the writing end side of the first scanning optical system is set to the same with the number of hold points on the writing start side of the second scanning optical system. Since the optical writing device is constituted in the above arrangement, it becomes possible to perform both of the jitter correction with high accuracy and the suppression of pitch unevenness.

(Other Effect)

Moreover, as shown in FIG. 2, between the transmissive optical elements disposed immediately before the separation mirrors 136 and 146 and the reflective optical elements after the separation mirrors 136 and 146, i.e., between the second scanning lens 134 and the third mirror 135 and between the second scanning lens 144 and the third mirror 145, the loci of two light beams B intersect with each other at the intersection region cl. In this way, by making the loci of light beams B intersect with each other, even if the size of the optical writing device 10 is made smaller, it is possible to secure the distance from the second scanning lens 134 to the third mirror 135. Moreover, by bringing the third mirror 135 close to the photoconductor drum 211 being a surface to be scanned, it is possible to suppress the influence due to the vibration of the third mirror 135.

Furthermore, as shown in FIG. 2, in the comparison between the first scanning optical system 13 and the second scanning optical system 14, in the second scanning optical system 14, the incident angle of the light beam B to the reflective optical element after the separation mirror is set to a more obtuse angle. That is, the incident angle of a light beam B in the third mirror 145 is set to a more obtuse angle than that in the third mirror 135. Moreover, as shown in FIG. 6, in the second scanning optical system 14, for each of the reflective optical elements, the number of hold points on the writing end side before the separation mirror 146 is made different from the number of hold points on the writing end side after the separation mirror 146. This is because position adjustment with higher accuracy is required for a mirror in which the incident angle is an obtuse angle. Thus, in the second scanning optical system 14 including the third mirror 145 in which the incident angle is set to the obtuse angle, by changing the arrangement of hold points before and after the separation mirror 146, it is possible to suppress the influence of twist or vibration more.

MODIFIED EXAMPLE

Figure 8:
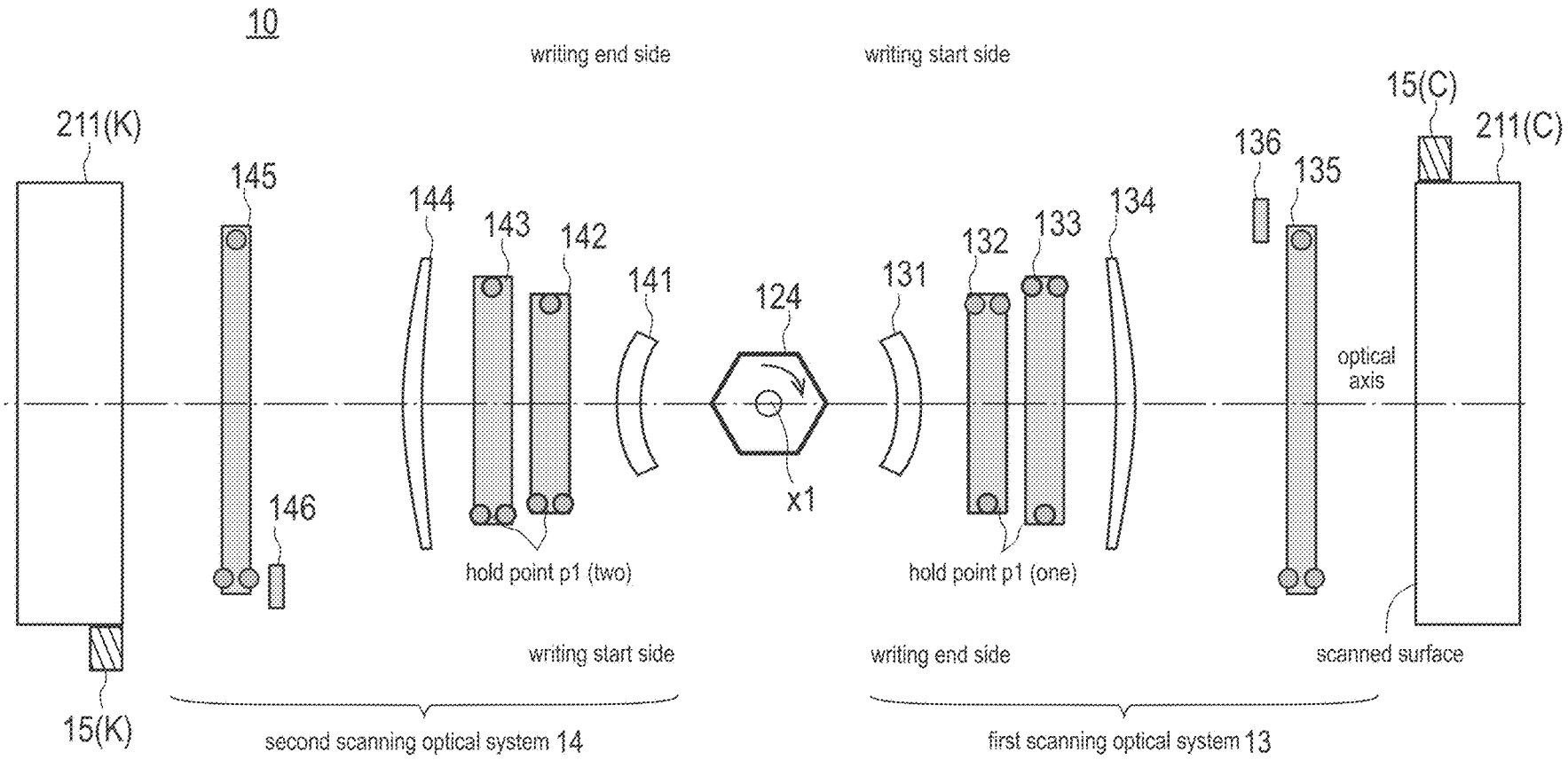
FIG. 8 is an illustration showing an optical writing device according to a modified example.

FIG. 8 is an illustration showing the optical writing device 10 according to a modified example. In FIG. 8, in the reflective optical elements disposed from after the polygon mirror 124 to before the separation mirrors 136 and 146, i.e., in the mirrors 132 and 133 of the first scanning optical system 13 and the mirrors 142 and 143 of the second scanning optical system 14, the number of hold points on the writing start side is set to two, and the number of hold points on the writing end side is set to one. In this way, by setting the number of hold points on the writing start side to two, since it is possible to suppress a deviation in a timing of a light beam to the SOS sensor 15 side more, jitter correction can be performed with higher accuracy.

In this connection, as a further modified example, for the constitution shown with FIG. 6 or FIG. 8, the number of hold points of the reflective optical elements disposed from after the separation mirrors 136 and 146 up to a surface to be scanned may be replaced between the writing start side and the writing end side. That is, the number of hold points on the writing start side of the third mirror 135 and the number of hold points on the writing end side of the third mirror 145 are set to two, and the number of hold points on the writing end side of the third mirror 135 and the number of hold points on the writing start side of the third mirror 145 are set to one. Even with such a constitution, the similar effects to that in the first embodiment or the modified example can be acquired.

Second Embodiment

Figure 9:
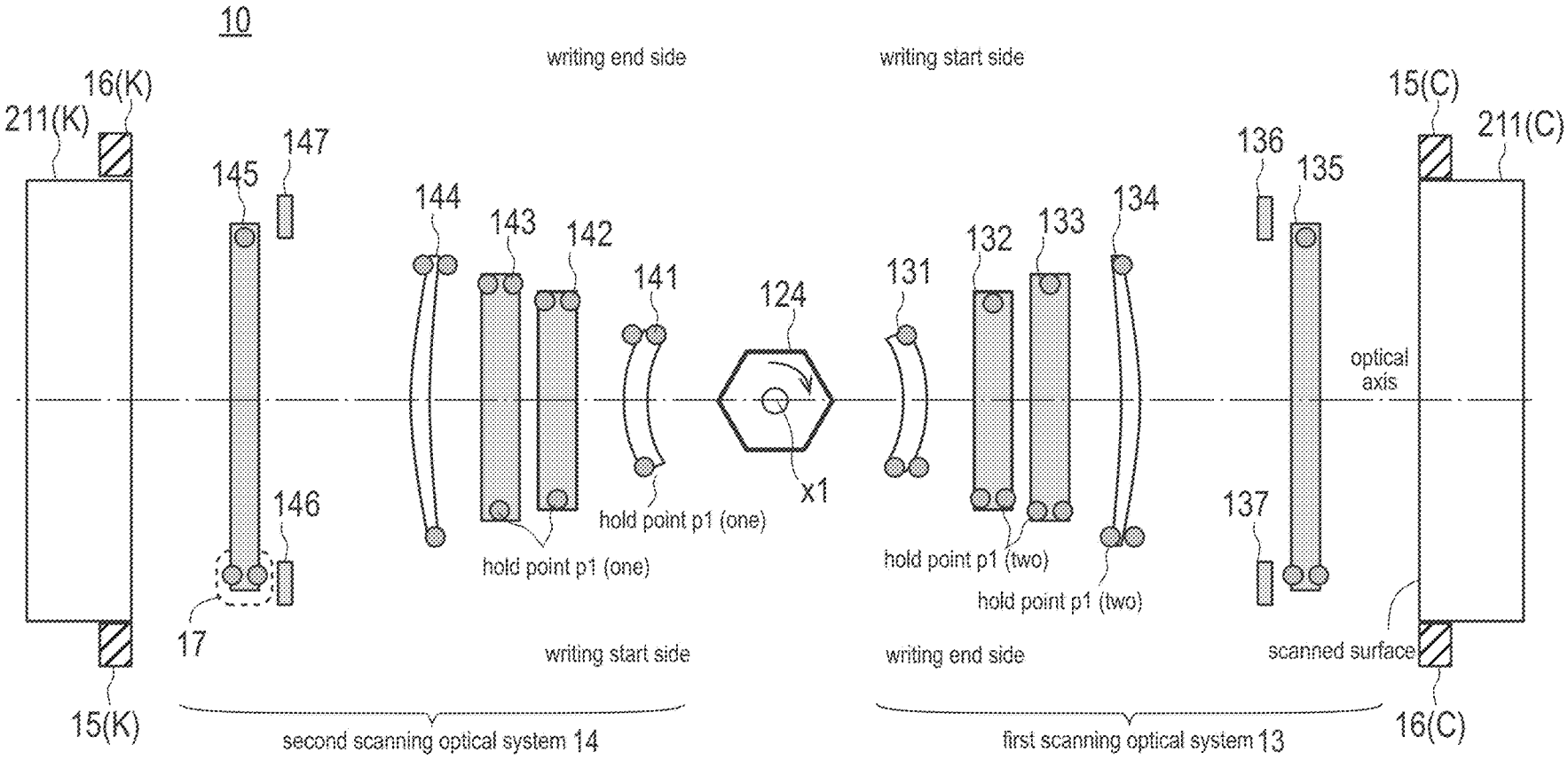
FIG. 9 is a schematic illustration showing an optical writing device according to the second embodiment.

FIG. 9 is a schematic illustration showing each of the optical elements of the optical writing device 10 according to the second embodiment by developing them in the optical axis direction. As shown in FIG. 9, in the second embodiment, an EOS (End Of Scan) sensor 16 is disposed. Moreover, in FIG. 9, the number of hold points is shown also with regard to the first scanning lens 131 and 141 and the second scanning lens 134 and 144. In this connection, in the corresponding schematic illustration other than FIG. 9, although the illustration with regard to the notation of the number of hold points in the transmissive optical elements is omitted, also the similar arrangement and number of hold points may be adopted, or also a constitution including hold points more than this may be adopted.

The EOS sensor 16 includes the constitution similar to that of the SOS sensor 15, and functions as "a second light detecting sensor". The EOS sensor 16 is used for controlling a writing end timing, and in addition, by cooperating with the SOS sensor 15, is also used for adjusting a magnification in the main scanning direction. In concrete terms, a light beam B having entered the separation mirror 137 (and separation mirror 147) is reflected thereon, and is guided to EOS sensor 16. The writing end timing of the main scanning line is adjusted by detecting the incident timing of the light beam B by the EOS sensor 16, whereby the magnification of the main scanning direction is adjusted. In the optical axis direction, the separation mirrors 137 and 147 are disposed at the positions corresponding to the separation mirrors 136 and 146 for the SOS sensor 15, respectively. Moreover, the position of the EOS sensor 16 is arranged at a position equivalent to a surface to be scanned in the optical axis direction.

In this way, in the second embodiment, by disposing the EOS sensor 16, in addition to the effects similar to those in the first embodiment, it is possible to perform the magnification adjustment in the main scanning direction with high accuracy. Moreover, before the separation mirror, the number of hold points of a reflective optical element on the writing end side is set to two, and the number of hold points on the writing start side is set to one. In this way, by setting the number of hold points on the EOS sensor 16 side (the writing end side) to two, it is possible to suppress the deviation of a light beam entering the EOS sensor 16 and to perform the correction of the magnification in the main scanning direction with high accuracy.

Moreover, with regard to each of the transmissive optical elements (scanning lenses 131, 141, 134, and 144) before the separation mirror, they are held at their both ends, and the number of hold points is different between the writing start side and the writing end side (similarly to the above-mentioned constitution (i)). Moreover, in the transmissive optical elements of each of the first scanning optical system 13 and the second scanning optical system 14, the number of hold points on the writing start side and the number of hold points on the writing end side are the same (similarly to the above-mentioned constitution (ii)).

In this way, in the second embodiment, also with regard to the transmissive optical elements, since the one point holding side is more easily influenced by twist or vibration, not only the above-mentioned constitutions (i) to (iii) for the reflective optical elements, but also the similar constitution is adopted for the transmissive optical elements, whereby jitter correction can be performed with higher accuracy.

Third Embodiment

Figure 10:
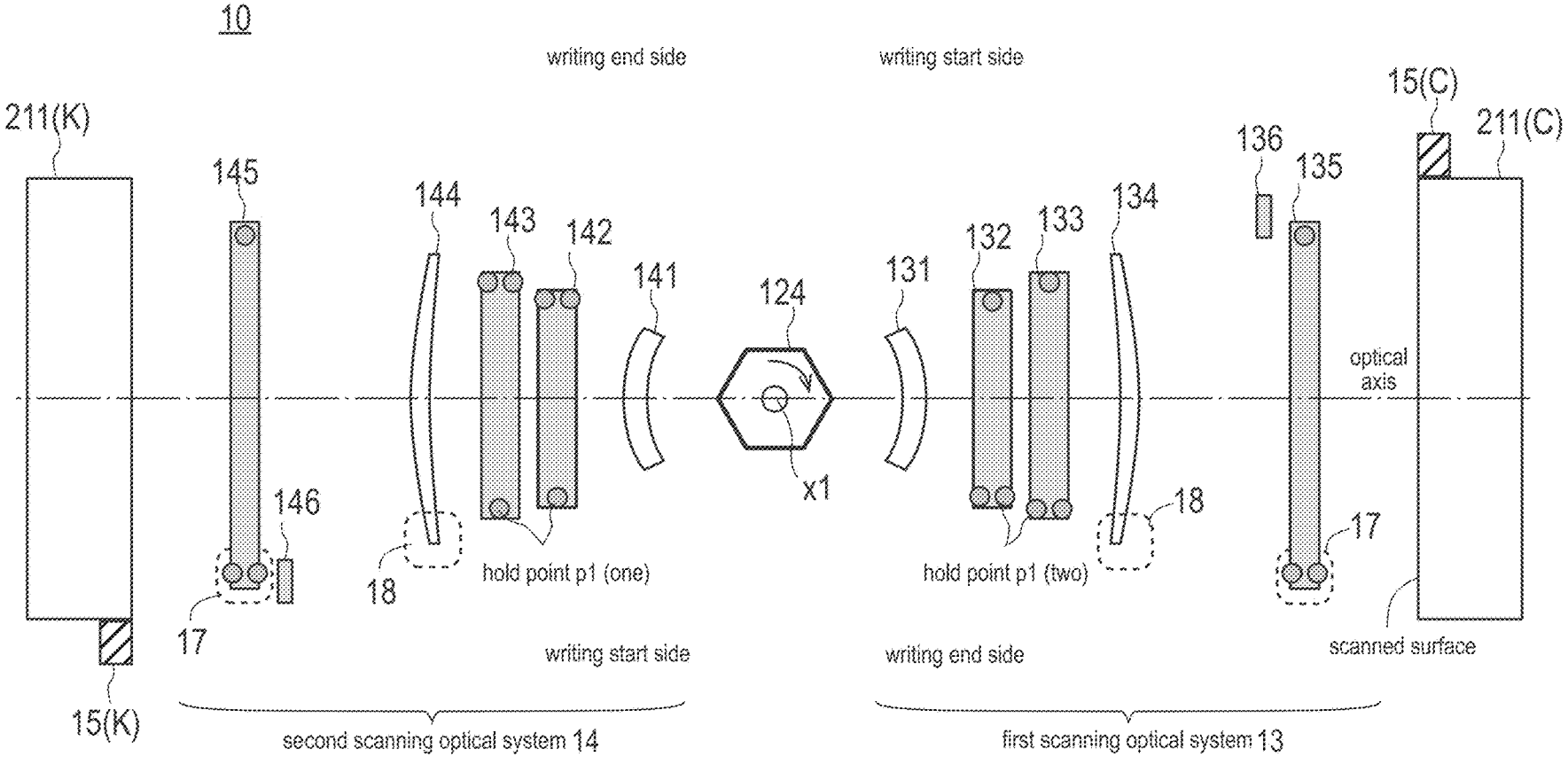
FIG. 10 is a schematic illustration showing an optical writing device according to the third embodiment.

The optical writing device 10 in the third embodiment includes a first adjustment mechanism 17 and a second adjustment mechanism 18. FIG. 10 is a schematic illustration showing the optical writing device 10 according to the third embodiment, and FIG. 11 is an illustration showing a constitution of the first adjustment mechanism 17.

As shown in FIG. 10, with regard to the reflective optical element after the separation mirror, i.e., the third mirror 135 and the third mirror 145, the first adjustment mechanism 17 is disposed on an end portion side at which two hold points are set, so as to make it possible to adjust an angle relative to the optical axis.

Figure 11:
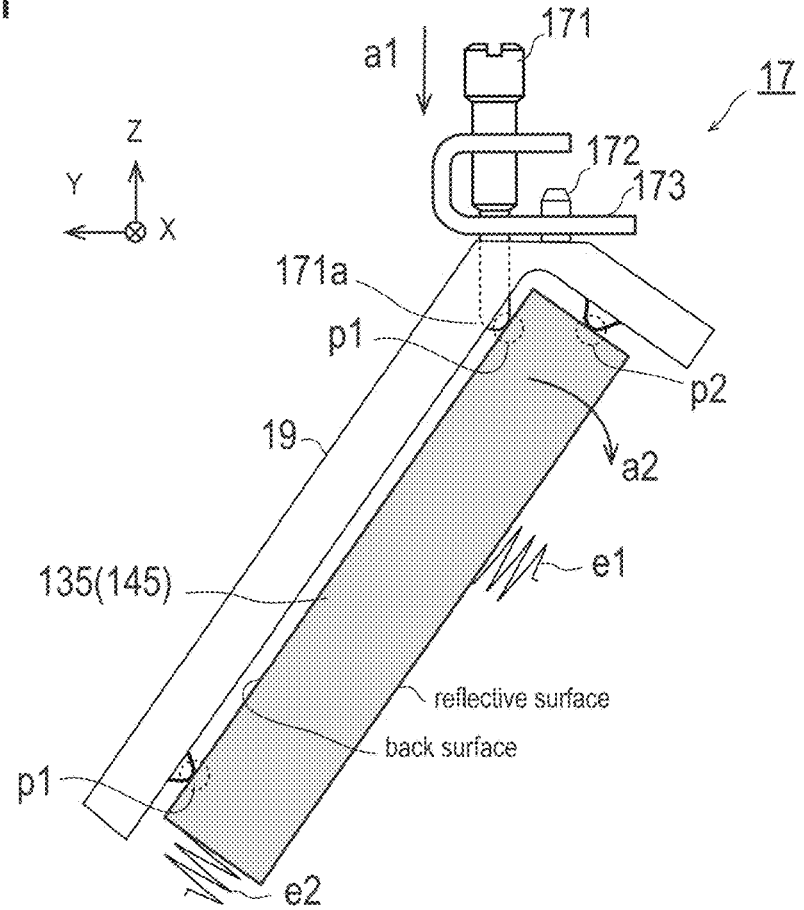
FIG. 11 is an illustration showing a constitution of a first adjustment mechanism.

As shown in FIG. 11, to the first adjustment mechanism 17 disposed on an end portion on the writing end side of the third mirror 135, a holder 173 is attached via a fixed pin 172 disposed on the housing 19 (lower housing 192). Then, by rotating an adjustable screw 171 attached to the holder 173, the adjustable screw 171 moves in the arrow a1 direction. By moving the tip end 171*a* of the adjustable screw 171 in the arrow a1 direction, the position of one hold point p1 among the two hold points p1 is changed. By making the tip end 171*a* protrude from the housing 19, the angle of the third mirror 135 is adjusted along the arrow a2 direction around an axis (X direction) along the main scanning direction serving as a rotation axis.

In this connection, in FIG. 11, in order to make an increment of adjustment small, the adjustable screw 171 is constituted so as to move in an oblique direct relative to the back surface of the mirror 135. However, the adjustable screw 171 may be constituted so as to move in the vertical direction relative to the back surface to follow along the adjustment direction. Moreover, as shown in FIG. 11, the third mirror 135 is urged by an elastic members e1, such as a plate spring, from a reflective surface side toward a positioning seat surface (a protruding portion or a tip end 171*a*) of the housing 19 corresponding to the hold point p1 on the back surface side. Moreover, similarly, also in the sub direction (direction orthogonal to the X direction), the third mirror 135 is urged by an elastic members e2 from one of the side-surface sides toward a positioning seat surface (corresponding to the hold point p2) of the housing 19 disposed on the other one of the side-surface sides.

Moreover, with regard to the transmissive optical elements from after the polygon mirror 124 to before the separation mirror, i.e., the second scanning lens 134 and the second scanning lens 144, the second adjustment mechanism 18 to move the hold point to hold the end portion side in the main scanning direction is disposed so as to make it possible to adjust the inclination of the optical axis direction. Among the first scanning optical system 13 and the second scanning optical system 14, in one scanning optical system of them, the second adjustment mechanism 18 is disposed on the writing start side, and in the other scanning optical system of them, the second adjustment mechanism 18 is disposed on the writing end side. For example, as shown in FIG. 10, in the first scanning optical system 13, the second adjustment mechanism 18 is disposed on the writing end side of the second scanning lens 134, and in the second scanning optical system 14, the second adjustment mechanism 18 is disposed on the writing start side of the second scanning lens 144. In concrete terms, with the similar constitution, by being urged toward three hold points by an elastic member, also the second scanning lens 134 and 144 are positioned, and by moving the positioning seat surface corresponding to the hold point of the end portion in the sub direction by the second adjustment mechanism 18, the second scanning lens 134 and 144 rotates in a YZ flat plane around an optical axis serving as the center of rotation. With this, the inclination adjustment (skew) in the optical axis direction is made.

In this connection, in the third embodiment, an example in which the second adjustment mechanism 18 is disposed on the second scanning lens 134 and 144, has been shown. However, in place of this example, or together with this example, the second adjustment mechanism 18 may be disposed on the first scanning lens 131 and 141.

In this way, in the third embodiment, the angle adjustment for the reflective optical element after the separation mirror, can be performed by the first adjustment mechanism 17. By doing in this way, it becomes possible to perform the registration adjustment in the sub-scanning direction without influencing a light beam B that enters the SOS sensor 15 or the SOS sensor 15 and the EOS sensor 16.

Moreover, in the third embodiment, among the first and second scanning optical systems 13 and 14, in one scanning optical system of them, the second adjustment mechanism 18 is disposed on the writing start side, and in the other scanning optical system of them, the second adjustment mechanism 18 is disposed on the writing end side. By doing in this way, the adjustment sides in the main scanning direction on an image can be aligned, and it becomes easy to align the registration position of each of the colors in the first and second scanning optical systems 13 and 14. That is, it becomes possible to perform the registration adjustment with high accuracy, and it becomes difficult to visually recognize color misalignment.

(Power of Transmissive Optical Element)

Figure 12:
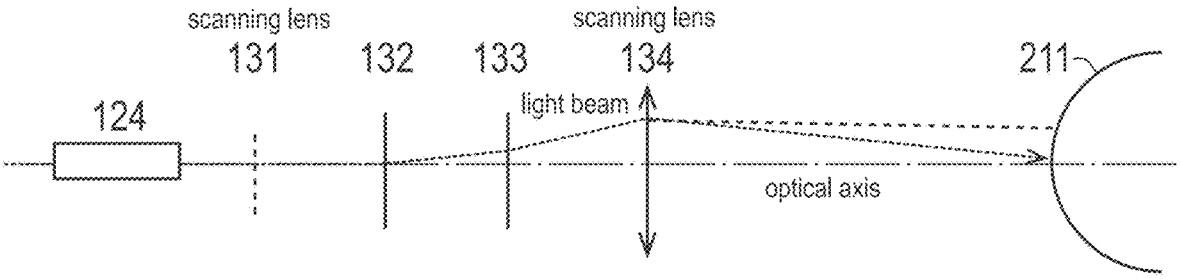
FIG. 12 is a schematic diagram showing a refraction state of a light beam in the sub-scanning direction by each of optical elements in a scanning optical system.

FIG. 12 is a schematic diagram showing a refraction state of a light beam in the sub-scanning direction by each optical element in the first scanning optical system 13. In FIG. 12, although the first scanning optical system 13 is taken as an example, also in the second scanning optical system 14, the similar constitution is adopted.

As shown in FIG. 12, in the optical elements (reflective optical elements or transmissive optical elements) from after the polygon mirror 124 to before the separation mirror 136 of the first scanning optical system 13, the power, in the sub-scanning direction, of the transmissive optical element disposed immediately before the separation mirror 136, i.e., the power of the second scanning lens 134, is set to be the largest. By doing in this way, it becomes possible to suppress the influence of the pitch unevenness due to vibration of the mirrors 132 and 133 before the second scanning lens 134. Moreover, with regard to the mirror 135, as mentioned in the above, by constituting such that the loci of two light beams B intersect with each other at the intersection region cl (refer to FIG. 2), the third mirror 135 is brought close to the photoconductor drum 211 being a surface to be scanned, whereby the influence due to vibration of the mirror 135 is suppressed.

OTHER MODIFIED EXAMPLE

With regard to the constitution of each of the optical writing device described in the above and the image forming apparatus equipped with this, the main constitution has been described for describing the feature of the above-described embodiment. Accordingly, the constitution is not limited to the above-described constitution, and within a scope of claims, various modification can be made. Moreover, the constitution equipped in a general optical writing device or an image forming apparatus is not excluded.

For example, in the embodiment shown in FIG. 6 and the like, shown has been an example in which, as the hold points of the reflective optical element, two hold points are disposed on one end portion and one hold point is disposed on the other end portion. However, without being limited to this, the reflective optical element may be held by hold points more than the above. Moreover, in FIG. 1, an example in which two optical writing devices are disposed, has been shown. However, four light source units may be disposed in a single writing device, and exposure corresponding to four colors may be performed for a photoconductor drum. Furthermore, in the third embodiment, an example in which the second adjustment mechanism 18 is disposed for each of the scanning optical systems one by one, has been shown. However, a plurality of second adjustment mechanisms 18 may be disposed. Moreover, in FIG. 1, an example in which the image forming apparatus is an intermediate transfer belt system, has been shown. However, an image forming apparatus of a transfer belt system in which a toner image is directly transferred from each photoconductor drum onto a sheet conveyed by a transfer belt, may be used.

Although embodiments of the present invention have been described and illustrated in detail, the disclosed embodiments are made for purpose of illustration and example only and not limitation The scope of the present invention should be interpreted by terms of the appended claims.

What is claimed is:

1. An optical writing device, comprising:

first and second light source units each of which includes one or more light sources;

a single polygon mirror that deflects a light beam emitted from each of the first and second light source units;

a first scanning optical system that includes one or more reflective optical elements to reflect a light beam and one or more transmissive optical elements to transmit a light beam and forms an image with a light beam emitted from the first light source unit and deflected by the polygon mirror;

a second scanning optical system that includes one or more reflective optical elements to reflect a light beam and one or more transmissive optical elements to transmit a light beam and forms an image with a light beam emitted from the second light source unit and deflected by the polygon mirror; and a plurality of first light detecting sensors that are disposed so as to correspond to respective light beams emitted from the first and second light source units and are used for controlling a writing start timing;

wherein the first and second light source units, the first and second scanning optical systems, and a housing for holding these components are constituted plane symmetrically relative to a plane including a rotation axis of the polygon mirror and being parallel to a scanning line, in the reflective optical elements held at both end sides in the main scanning direction in the first and second scanning optical systems, a number of hold points for positioning is different between a writing start side and a writing end side in scanning of a light beam, in the reflective optical elements of the first and second scanning optical systems disposed in the optical axis direction from after the polygon mirror to before a separation mirror to guide a light beam to the first light detecting sensor, a number of hold points on each of a writing start side and a writing end side in scanning is same, and in the reflective optical elements disposed from after the separation mirror up to a surface to be scanned, a number of hold points on the writing start side of the first scanning optical system is same with a number of hold points on the writing end side of the second scanning optical system, and a number of hold points on the writing end side of the first scanning optical system is set to same with a number of hold points on the writing start side of the second scanning optical system.

2. The optical writing device according to claim 1, wherein the hold points are hold points for positioning in the optical axis direction of the reflective optical element, and two hold points are disposed at one end potion direction and one hold point is disposed at other end potion in the main scanning.

3. The optical writing device according to claim 2, further comprising:

a first adjusting mechanism, wherein the first adjusting mechanism makes it possible to perform angle adjustment around an axis along the main scanning direction as a rotation axis on the one end portion side where the two hold points are set, for the reflective optical element disposed from after the separation mirror up to a surface to be scanned.

4. The optical writing device according to claim 1, wherein in the transmissive optical element held at both end sides in the main scanning direction in the first and second scanning optical systems, a number of hold points for positioning is different between a writing start side and a writing end side, and in the transmissive optical elements disposed from after the polygon mirror to before the separation mirror, in the first scanning optical system and the second scanning optical system, a number of hold points on each of a writing start side and a writing end side is same.

5. The optical writing device according to claim 1, further comprising:

a plurality of second light detecting sensors that are disposed so as to correspond to respective light beams emitted from the first and second light source units and are used for controlling a writing end timing.

6. The optical writing device according to claim 5, wherein in the reflective optical elements disposed from after the polygon mirror and to before the separation mirror, two hold points are set on a writing end side, and on hold point is set on a writing start side.

7. The optical writing device according to claim 1, further comprising:

a second adjusting mechanism, wherein the second adjusting mechanism makes it possible to perform inclination adjustment in the optical axis direction of the transmissive optical element by moving the hold point for holding an end portion side in the main scanning direction for at least one of the transmissive optical elements disposed from after the polygon mirror and to before the separation mirror in each of the first and second scanning optical systems, and the second adjusting mechanism is disposed on a writing start side in one scanning optical system among the first and second scanning optical systems and is disposed on a writing end side in other scanning optical system.

8. The optical writing device according to claim 1, wherein in a plurality of the transmissive optical elements disposed from after the polygon mirror and to before the separation mirror, a power in the sub-scanning direction in the transmissive optical element disposed immediately before the separation mirror is set to become largest.

9. The optical writing device according to claim 1, wherein in a space from the transmissive optical element disposed immediately before the separation mirror up to the reflective optical element after the separation mirror, a locus of a light beam emitted from the first light source unit and a locus of a light beam emitted from the second light source unit intersect with each other.

10. The optical writing device according to claim 1, wherein among the first and second scanning optical systems, in one scanning optical system in which an incident angle of a light beam to the reflective optical element after the separation mirror is set to be a more obtuse angle, a number of hold points on a writing end side in the reflective optical element before the separation mirror is made different from a number of hold points on a writing start side in the reflective optical element after the separation mirror.

11. An image forming apparatus, comprising:

the optical writing device according to claim 1; and an image former including a photoconductor that is exposed with a light beam from the optical writing device.

* * * * *